US009061847B2

(12) United States Patent
Yoshinaga

(10) Patent No.: US 9,061,847 B2
(45) Date of Patent: Jun. 23, 2015

(54) SHEET TRANSPORT MECHANISM AND IMAGE FORMING DEVICE PROVIDED WITH SAME

(71) Applicant: KYOCERA Document Solutions Inc., Osaka (JP)

(72) Inventor: Shinji Yoshinaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/467,904

(22) Filed: Aug. 25, 2014

(65) Prior Publication Data

US 2015/0061220 A1 Mar. 5, 2015

(30) Foreign Application Priority Data

Aug. 30, 2013 (JP) ..... 2013-179436

(51) Int. Cl.
*B65H 5/36* (2006.01)
*B65H 5/06* (2006.01)

(52) U.S. Cl.
CPC ..... *B65H 5/068* (2013.01); *B65H 5/36* (2013.01); *B65H 2404/143* (2013.01); *B65H 2404/1431* (2013.01); *B65H 2404/1451* (2013.01); *B65H 2404/144* (2013.01)

(58) Field of Classification Search
CPC .... B65H 5/36; B65H 5/068; B65H 2404/143; B65H 2404/1431; B65H 2404/144; B65H 2404/1451
USPC ..... 271/274, 273
See application file for complete search history.

(56) References Cited

U.S. PATENT DOCUMENTS

| | | | | |
|---|---|---|---|---|
| 7,500,670 | B2 * | 3/2009 | Kitazawa | 271/274 |
| 7,523,933 | B2 * | 4/2009 | Linder et al. | 271/274 |
| 7,900,919 | B2 * | 3/2011 | Ledgerwood et al. | 271/274 |
| 8,746,697 | B2 * | 6/2014 | Kondo | 271/274 |
| 2002/0130463 | A1 * | 9/2002 | Michel | 271/274 |
| 2004/0245715 | A1 * | 12/2004 | Zheng | 271/274 |
| 2006/0012112 | A1 | 1/2006 | Kitazawa | 271/272 |
| 2006/0261540 | A1 * | 11/2006 | Loiselle et al. | 271/228 |
| 2007/0018387 | A1 * | 1/2007 | Yamamoto | 271/272 |
| 2009/0140486 | A1 | 6/2009 | Kitazawa | 271/3.14 |
| 2010/0310280 | A1 * | 12/2010 | Kondo et al. | 399/297 |
| 2012/0051825 | A1 * | 3/2012 | Ogasawara et al. | 400/611 |
| 2013/0200567 | A1 * | 8/2013 | Saito | 271/306 |
| 2014/0091518 | A1 * | 4/2014 | Nishii et al. | 271/274 |

FOREIGN PATENT DOCUMENTS

JP 2006-27811 A 2/2006

* cited by examiner

*Primary Examiner* — Patrick Cicchino
(74) *Attorney, Agent, or Firm* — Stein IP, LLC

(57) ABSTRACT

The sheet transport mechanism of the present disclosure is provided with drive roller, driven roller, and roller pressing mechanism. The roller pressing mechanism presses the driven roller into contact against the drive roller. The driven roller includes a central driven roller, a first rotating shaft for supporting the central driven roller, at least one pair of outside driven rollers, and second rotating shafts supporting the outside driven rollers. The roller pressing mechanism includes a central pressing mechanism, and an outside pressing mechanism. The central pressing mechanism presses the central driven roller against the drive roller. The outside pressing mechanism presses the outside driven rollers against the drive roller.

8 Claims, 5 Drawing Sheets

SHEET TRANSPORT MECHANISM AND IMAGE FORMING DEVICE PROVIDED WITH SAME

INCORPORATION BY REFERENCE

This application claims the benefit of Japanese Application No. 2013-179436, filed Aug. 30, 2013, in the Japanese Patent Office. All disclosures of the documents named above are incorporated herein by reference.

BACKGROUND OF THE INVENTION

The present disclosure relates to a sheet transport mechanism for transporting a recording medium of sheet form, such as paper or the like, in an image forming device such as a fax machine, copier, printer, or the like, and to an image forming device provided with the same.

In image forming devices such as fax machines, copiers, printers, and the like, sheet transport mechanisms in which pairs of transport rollers, composed of pairs of rollers pressed into contact with one another, rotate in order to transport a sheet while pinched in the nip of the pair of rollers, are widely employed as means for transporting sheets (recording media) such as paper, cloth, OHP sheets, and the like.

In this sort of sheet transport mechanism, one of the rollers constituting the transport roller pair is pressed into contact against the other roller at a predetermined pressure, by means of a tension spring, compression spring, or the like. In the past, the typical method for doing so was to furnish individual springs at left and right in the axial direction of the transport roller pair, and to press one roller against the other roller.

However, when individual springs are furnished at left and right in the axial direction, variability in the dimensions of the springs may cause the pressing force on the transport roller pair to differ between left and right in the axial direction. As a result, the transporting force acting on the sheet may be uneven between left and right in the axial direction, causing the sheet to experience oblique motion.

SUMMARY OF THE INVENTION

The sheet transport mechanism according to one aspect of the present disclosure is provided with transport roller pairs, and roller pressing mechanism. The transport roller pairs are composed of drive roller and driven roller. The drive roller is rotated by drive power from a drive source. The driven roller is pressed into contact against the drive roller and passively driven thereby. The roller pressing mechanism presses the driven roller into contact against the drive roller. The sheet transport mechanism transports a recording medium pinched in a nip section of the transport roller pairs. The driven roller includes a central driven roller disposed to the center side in the axial direction, with a first rotating shaft for supporting the central driven roller, at least one pair of outside driven rollers arranged symmetrically on either side of the central driven roller in an axial direction, and with second rotating shafts for supporting the outside driven rollers. The roller pressing mechanism includes a central pressing mechanism for pressing the central driven roller against the drive roller, and an outside pressing mechanism for pressing the outside driven rollers against the drive roller.

Other objects of the present disclosure, and specific advantages afforded by the present disclosure, will become more apparent from the following description of the preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

The embodiments of the present disclosure will be described below with reference to the drawings.

An image forming device in which the sheet transport mechanism according to an embodiment of the present disclosure has been installed will be described with reference to FIGS. 1 to 6. Here, an ink jet printer 100 is described as the image forming device.

Figure 1:
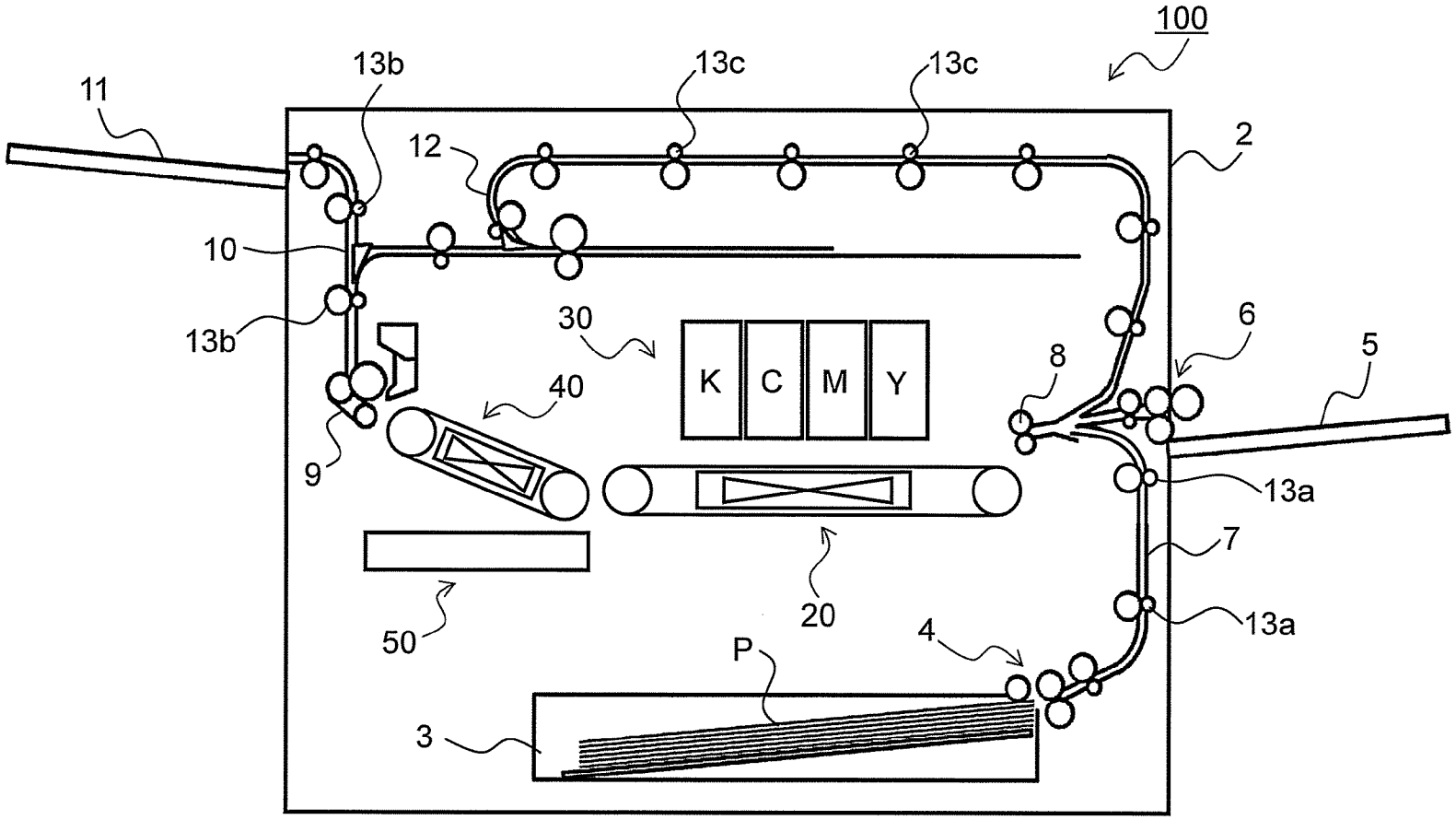
FIG. 1 is a cross sectional view showing the entire structure of an image forming device equipped with the sheet transport mechanism according to an embodiment of the present disclosure.

As shown in FIG. 1, the printer 100 is equipped with a paper supply cassette 3 disposed in a lower part of the interior of a printer body 2, and serving as a paper receptacle. The paper supply cassette 3 accommodates a stack of a prescribed number of sheets (for example, about 500) of paper P, such as unprinted cut paper, by way of an exemplary recording medium. A paper feed device 4 is disposed to the downstream side, in the direction of paper transport, from the paper supply cassette 3, and specifically above the right side of the paper supply cassette 3 in FIG. 1. The paper P is separated and fed one sheet at a time upward and to the right of the paper supply cassette 3 in FIG. 1 by the paper feed device 4. The paper supply cassette 3 is capable of being pulled out horizontally from the front face side of the printer body 2, in order to be refilled with paper P.

A manual paper feed tray 5 is provided to the outside of the right side face of the printer body 2. Into the manual paper feed tray 5 is placed paper of sizes different from the paper P inside the paper supply cassette 3, thick paper, OHP sheets, envelopes, postcards, invoices, or other such recording media that do not readily pass over a transport path inflected, or recording media desired to feed one sheet at a time, and the like. A paper feed device 6 is disposed to the downstream side, in the direction of paper transport, from the manual paper feed tray 5, specifically, to the left side of the manual paper feed tray 5 in FIG. 1. Paper positioned on the manual paper feed tray 5 is separated and fed one sheet at a time to the left in FIG. 1 by this paper feed device 6.

The printer 100 is additionally provided in the interior thereof with a first paper transport path 7. The first paper transport path 7, in relation to the paper supply cassette 3, is located above and to the right which is the paper feed direction; and in relation to the manual paper feed tray 5 is located leftward. The paper P fed out from the paper supply cassette 3 is transported vertically upward along a side face of the printer body 2 by the first printer paper transport path 7, while paper fed out from the manual paper feed tray 5 is transported horizontally leftward.

A resist roller pair 8 is provided at the downstream end of the first printer paper transport path 7 in relation to the paper transport direction. A first belt transport part 20 and a recording part 30 are disposed in proximity to the downstream side of the resist roller pair 8. The paper P fed out from the paper supply cassette 3 (or from the manual paper feed tray 5) reaches the resist roller pair 8 through the first printer paper transport path 7. The resist roller pair 8, while correcting diagonal feed of the paper P, feeds the paper P towards the first belt transport part 20, at a timing coordinated with an ink ejection operation executed by the recording part 30. Transport roller pairs 13*a* for transporting the paper P are furnished at appropriate locations along the first printer paper transport path 7.

In order to prevent ink ejection failure due to clogging or drying out of the print head, the recording part 30, when commencing a print operation after being idle for a prolonged period, executes a purge, doing so from all of the ink ejection nozzles (not illustrated) of the recording head, or during the interim between printing operations, from ink ejection nozzles for which the quantity of ink ejected therefrom is equal to or less than a prescribed value, in order to eject ink that has increased in viscosity within the nozzles, and prepare for the next printing operation.

A second belt transport part 40 is disposed to the downstream side (the left side in FIG. 1) from the first belt transport part 20 in relation to the paper transport direction. The paper P on which an ink image has been recorded by the recording part 30 is feed to the second belt transport part 40, and the ink ejected onto the paper P surface is dried during passage through the second belt transport part 40.

A decurler part 9 is provided to the downstream from the second belt transport part 40 in relation to the paper transport direction, in proximity to the left side face of the printer body 2. The paper P onto which the ink has been dried in the second belt transport part 40 is fed to the decurler part 9, where curling is corrected by a plurality of rollers lined up in the paper width direction.

A second paper transport path 10 is provided to the downstream side (the upper side in FIG. 1) of the decurler part 9 in relation to the paper transport direction. In cases in which the paper P passing through the decurler part 9 has not been printed on both sides, it is discharged, via discharge rollers, from the second paper transport path 10 into a paper discharge tray 11 furnished outside the left side of the printer 100. The second paper transport path 10, like the first paper transport path 7, is furnished at appropriate locations with transport roller pairs 13*b* for transporting the paper P.

A maintenance unit 50 is disposed below the second transport part 40. During execution of a purge as discussed above, the maintenance unit 50 moves to below the recording part 30, wipes the ink ejected from the ink discharge nozzles of the recording head, and recovers the wiped ink.

A reverse transport path 12 for performing duplex recording is provided above the recording part 30 and the second belt transport part 40, in an upper part of the printer body 2. In the case of performing duplex recording, once recording of the first side is finished, the paper P having passed through the second belt transport part 40 and the decurler part 9 is fed onto the reverse transport path 12 through the second transport path 10. The transport direction of the paper P fed onto the reverse transport path 12 is then switched in order to record the second side, and is fed towards the right side while passing through the upper part of the printer body 2, and again fed into the first belt transport part 20 through the resist roller pair 8, with the second side facing up. The reverse transport path 12, like the first paper transport path 7, is furnished at appropriate locations with transport roller pairs 13*c* for transporting the paper P.

Next, the sheet transport mechanism of an embodiment of the present disclosure will be described. Here, a case in which the transport roller pairs 13*a* are employed as the sheet transport mechanism of the present disclosure will be described.

Figure 2:
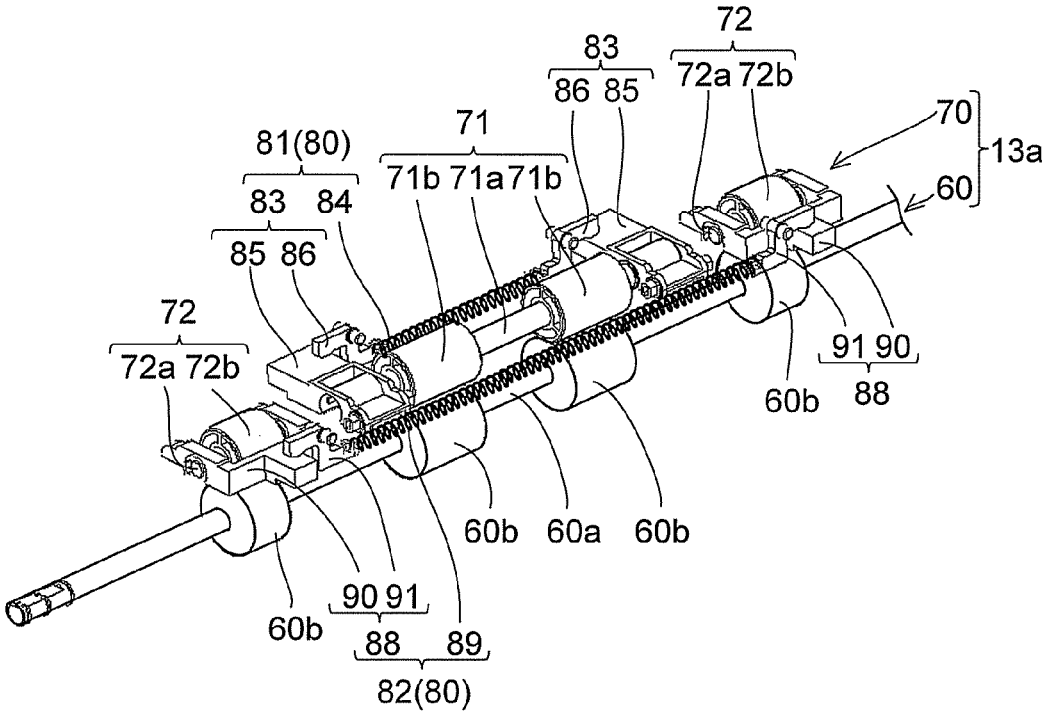
FIG. 2 is a perspective view showing the structure of the sheet transport mechanism according to an embodiment of the present disclosure.

As shown in FIG. 2, the sheet transport mechanism of the embodiment of the present disclosure includes transport roller pairs 13*a*, and a roller pressing mechanism 80 for pressing a driven roller 70, discussed later, against a drive roller 60 of the transport roller pairs 13*a*, which transport the paper P while pinched in the nip part of the transport roller pairs 13*a*.

The transport roller pairs 13*a* are composed of the drive roller 60 which is rotated by drive power from a drive source, and the driven roller 70 which is rotated by being driven while pressed against the drive roller 60. The driven roller 70 includes a central roller (central driven roller) 71 disposed towards the center side in an axial direction, and a pair of outside rollers (outside driven rollers) 72 disposed symmetrically on either side of the central roller 71 in an axial direction.

The drive roller 60 includes a rotating shaft 60*a* and a plurality (in this instance, four) of roller elements 60*b* secured about the outside peripheral face of the rotating shaft 60*a* in the paper width direction (the axial direction of the rotating shaft 60*a*). The rotating shaft 60*a* of the drive roller 60 is rotatably supported by a pair of side panel frames (not illustrated) disposed in the longitudinal direction (a direction perpendicular to the plane of the page in FIG. 1) of the printer body 2, with drive power from a power source such as a motor or the like (not illustrated) input to one end of the rotating shaft 60*a*.

Figure 3:
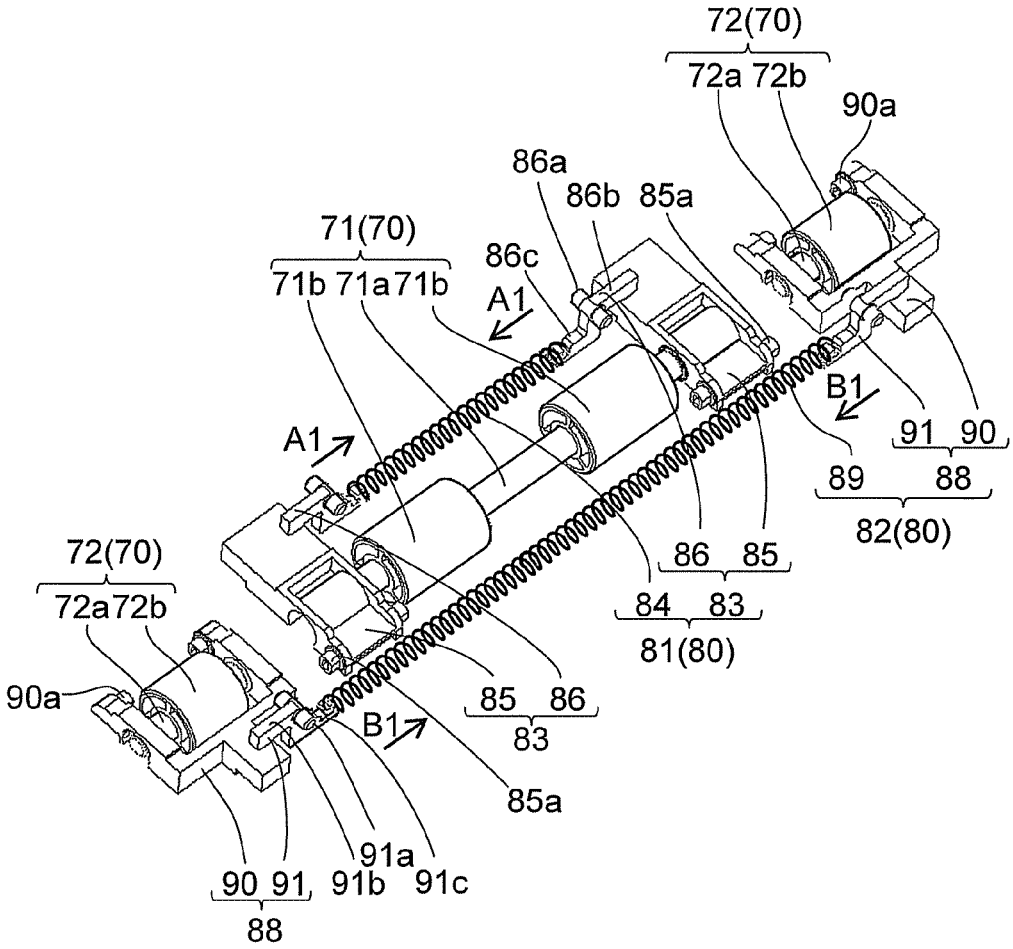
FIG. 3 is a perspective view showing the structure of driven roller and a roller pressing mechanism of the sheet transport mechanism according to an embodiment of the present disclosure.

The central roller 71 includes a rotating shaft (first rotating shaft) 71*a*, and two roller elements 71*b* secured along the outside peripheral face of the rotating shaft 71*a* in the paper width direction. The roller elements 71*b* are disposed at locations facing the central roller elements 60*b* of the drive roller 60. Each of the outside rollers 72 includes a rotating shaft (second rotating shaft) 72*a* and a single roller element 72*b* secured to the outside peripheral face of the rotating shaft 72*a*. The roller elements 72*b* are disposed at locations facing the outside roller elements 60*b* of the drive roller 60. As shown in FIG. 3, the two rotating shafts 72*a* are arranged in mutually coaxial fashion, as well as being arranged positioned coaxially to the rotating shaft 71*a* when central roller 71 and the outside rollers 72 are pressed against the drive roller 60.

The roller elements 60*b* of the drive roller 60 are formed from elastic material such as rubber or the like, and the roller elements 71*b* and 72*b* of the driven roller 70 are formed of resin material having higher hardness than the roller elements 60*b*. In so doing, the transporting force produced during transport of the multifunction paper through frictional force of the drive roller 60 and the driven roller 70 can be enhanced.

The roller pressing mechanism 80 includes a central pressing mechanism 81 for pressing the central roller 71 against the drive roller 60, and an outside pressing mechanism 82 for pressing the pair of outside rollers 72 against the drive roller 60 under uniform pressing force.

The central pressing mechanism 81 has a pair of central pressing members 83 for pressing on both ends of the rotating shaft 71*a* of the central roller 71 towards the drive roller 60 side, and a central urging member 84 linked to the pair of central pressing members 83 and urging the central pressing members 83 to impart pressing force. The central urging member 84 is designed such that the pressing force of the central pressing members 83 exceeds the pressing force of outside pressing members 88, discussed below.

Each of the central pressing members 83 includes a first lever 85, and a second lever 86 abutting the first lever 85.

Figure 4:
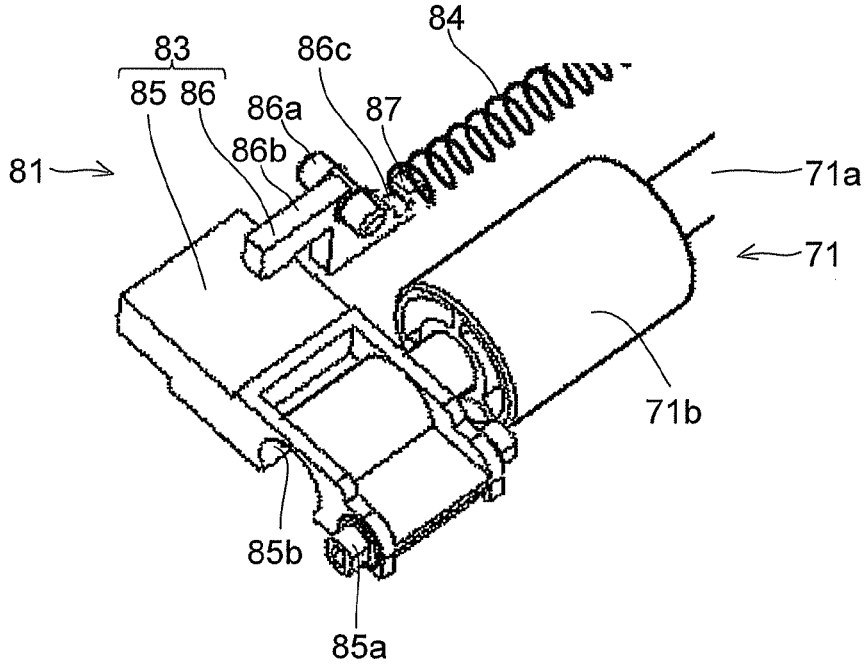
FIG. 4 is an enlarged perspective view showing the structure in the vicinity of a central pressing member of the sheet transport mechanism according to an embodiment of the present disclosure.
Figure 5:
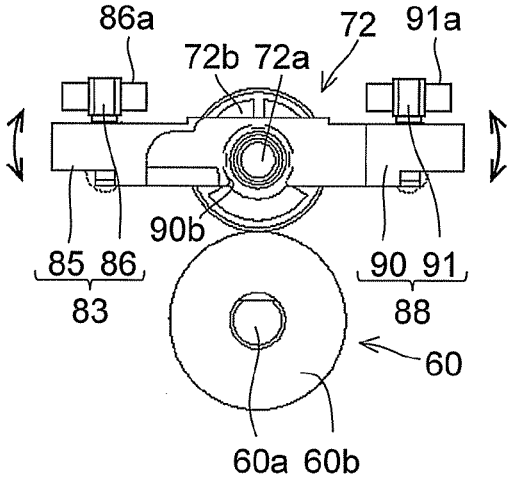
FIG. 5 is a side view showing the structure of the sheet transport mechanism according to an embodiment of the present disclosure.

As shown in FIG. 4, the first lever 85 is supported on a frame (not illustrated) of the printer body 2 so as to be pivotable about a first pivot shaft 85*a*. The first pivot shaft 85*a* extends in a direction parallel to the rotating shaft 60*a* of the drive roller 60 and the rotating shafts 71*a* and 72*a* of the driven roller 70 (a direction perpendicular to the plane of the page in FIG. 1).

In an approximate center portion of the first lever 85 there is formed a bearing portion 85*b* adapted to rotatably support an end of the rotating shaft 71*a* of the central roller 71, making it possible for the end of the rotating shaft 71*a* to be pressed towards the drive roller 60 side. By pivoting of the first lever 85 about the first pivot shaft 85*a* in a counterclockwise direction or clockwise direction in FIG. 5, the central roller 71 pivots in a direction approaching or moving away from the drive roller 60.

As shown in FIG. 4, the second lever 86 is supported on the frame (not illustrated) of the printer body 2 so as to be pivotable about a second pivot shaft 86*a* orthogonal to the first pivot shaft 85*a*. The second lever 86 is of crank shape having a first arm portion (abutting portion) 86*b* that protrudes out towards an axial end of the central roller 71 from the second pivot shaft 86*a* and abuts the first lever 85, and a second arm portion (linking portion) 86*c* that protrudes out in an "L" shape towards an axial center portion of the central roller 71 from the second pivot shaft 86*a*. A hook portion 87 is formed at the distal end of the second arm portion 86*c* of each of the second levers 86, and the central urging member 84 is linked at both ends thereto.

The second pivot shaft 86*a* extends in a direction orthogonal to the rotating shaft 60*a* of the drive roller 60 and the rotating shafts 71*a*, 72*a* of the driven roller 70.

The central urging member 84 comprises a tension spring, and urges the second lever 86 in a direction parallel to the rotating shaft 71*a* of the central roller 71.

As shown in FIG. 3, the outside pressing mechanism 82 has a pair of outside pressing members 88 for pressing the rotating shafts 72*a* of the pair of outside rollers 72 towards the drive roller 60 side, and an outside urging member 89 linked to the pair of outside pressing members 88, and urging the outside pressing members 88 to impart pressing force.

Each of the outside pressing members 88 includes a third lever 90, and a fourth lever 91 abutting the third lever 90.

Figure 6:
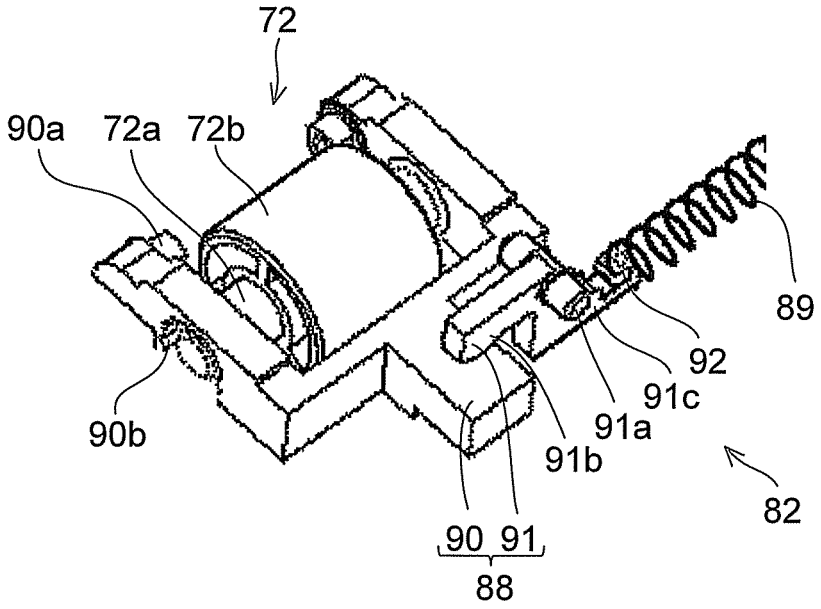
FIG. 6 is enlarged perspective view showing the structure in the vicinity of an outside pressing member of the sheet transport mechanism according to an embodiment of the present disclosure.

As shown in FIG. 6, the third lever 90 is supported on the frame (not illustrated) of the printer body 2 so as to be pivotable about a third pivot shaft 90*a*. The third pivot shaft 90*a* extends in a direction parallel to the rotating shaft 60*a* of the drive roller 60 and the rotating shafts 71*a* and 72*a* of the driven roller 70.

In an approximate center portion of the third lever 90 there is formed bearing portions 90*b* adapted to rotatably support both ends of the rotating shaft 72*a* of the outside roller 72, making it possible for both ends of the rotating shaft 72*a* to be pressed towards the drive roller 60 side. By pivoting of the third lever 90 about the third pivot shaft 90*a* in the clockwise direction or counterclockwise direction in FIG. 5, the outside roller 72 pivots in a direction approaching or moving away from the drive roller 60.

The fourth lever 91 is supported on the frame (not illustrated) of the printer body 2 so as to be pivotable about a fourth pivot shaft 91*a* orthogonal to the third pivot shaft 90*a*. The fourth lever 91 is of crank shape having a third arm portion 91*b* that protrudes out towards an axial end of the driven roller 70 from the fourth pivot shaft 91*a* and abuts the third lever 90, and a fourth arm portion 91*c* that protrudes out in an "L" shape towards an axial center portion of the driven roller 70 from the fourth pivot shaft 91*a*. A hook portion 92 is formed at the distal end of the fourth arm portion 91*c* of each of the fourth levers 91, and the outside urging member 89 is linked at both ends thereto.

The fourth pivot shaft 91*a* extends in a direction orthogonal to the rotating shaft 60*a* of the drive roller 60 and the rotating shafts 71*a*, 72*a* of the driven roller 70.

The outside urging member, 89 comprises a tension spring, and urges the fourth lever 91 in a direction parallel to the rotating shaft 72*a* of the outer roller 72. As shown in FIG. 3, the outside urging member 89 is disposed to the opposite side from the central urging member 84 with respect to the driven roller 70, and the third pivot shaft 90*a* of the third lever 90 is disposed to the opposite side from the first pivot shaft 85*a* of the first lever 85 with respect to the driven roller 70.

Turning to a description of operation of the roller pressing mechanism 80, the second arm portion 86*c* is pulled in the direction of arrow A1 by the urging force of the central urging member 84. In so doing, the second lever 86 pivots, and the first arm portion 86*b* presses the first lever 85 in the downward direction of FIG. 3, whereby the first lever 85 pivots in the counterclockwise direction in FIG. 5 about the first pivot shaft 85*a*. In so doing, the central roller 71, which is supported by the bearing portion 85*b* of the first lever 85, is pressed into contact against the drive roller 60.

Likewise, the fourth arm portion 91*c* is pulled in the direction of arrow B1 by the urging force of the outside urging member 89. In so doing, the fourth lever 91 pivots, and the third arm portion 91*b* presses the third lever 90 in the downward direction of FIG. 3, whereby the third lever 90 pivots in the clockwise direction in FIG. 5 about the third pivot shaft 90*a*. In so doing, the outside roller 72, which is supported by the bearing portion 90*b* of the third lever 90, is pressed into contact against the drive roller 60.

In the present embodiment, in the aforedescribed manner, the driven roller 70 includes the central roller 71 which is disposed to the center side in the axial direction, and the pair of outside rollers 72 which are disposed to the outside in the axial direction, while the roller pressing mechanism 80 includes the central pressing mechanism 81 for pressing the central roller 71 against the drive roller 60, and the outside pressing mechanism 82 for pressing the outside rollers 72 against the drive roller 60. In so doing, even in cases in which the rotating shaft 60*a* of the drive roller 60 flexes due to low rigidity of the rotating shaft 60*a*, the central roller 71 can be pressed into contact against the drive roller 60 by the central pressing mechanism 81. For this reason, diminished pressing force at the center side can be avoided, and therefore small-sized paper (for example, postcards or envelopes) can be transported with good accuracy.

Additionally, the central pressing mechanism 81 has the pair of central pressing members 83 for pressing on both ends of the rotating shaft 71*a* of the central roller 71 towards the drive roller 60 side, and the central urging member 84 which is linked to the pair of central pressing members 83 and urges the central pressing members 83 to impart pressing force. In so doing, both ends of the central roller 71 can be pressed uniformly, whereby variability of the central pressing force at either side in the axial direction can be minimized. Moreover, the outside pressing mechanism 82 has the pair of outside pressing members 88 for pressing the pair of outside rollers 72 towards the drive roller 60 side, and the outside urging member 89 linked to the pair of outside pressing members 88, and urging the outside pressing members 88 to impart pressing force. In so doing, the pair of outside rollers 72 can be pressed uniformly, whereby variability of the outside pressing force at either side in the axial direction can be minimized. As a result, variability of the pressing force of the transport roller pairs 13*a* at either side in the axial direction can be minimized.

In the aforedescribed manner, the pressing force produced by the central pressing member 83 exceeds the pressing force produced by the outside pressing member 88. In so doing, the central roller 71 can be pressed into contact against the drive roller 60 in a more reliable manner, even in cases in which the rotating shaft 60*a* of the drive roller 60 flexes due to low rigidity of the rotating shaft 60*a*.

Moreover, in the aforedescribed manner, the central urging member 84 is linked to the pair of second levers 86 and urges the second levers 86 in the direction parallel to the rotating shaft 71*a*, whereupon the second levers 86, under the urging force of the central urging member 84, pivot in a direction of pressing the first levers 85, thereby pressing the central roller 71 into contact against the drive roller 60. In so doing, both ends of the central roller 71 can be readily pressed in uniform fashion by the central urging member 84, the pair of second levers 86, and the pair of first levers 85.

Moreover, in the aforedescribed manner, the outside urging member 89 is linked to the pair of fourth levers 91 and urges the fourth levers 91 in the direction parallel to the rotating shaft 72*a*, whereupon the fourth levers 91, under the urging force of the outside urging member 89, pivot in a direction of pressing the third levers 90, thereby pressing the pair of outside rollers 72 into contact against the drive roller 60. In so doing, the pair of outside rollers 72 can be readily pressed in uniform fashion by the outside urging member 89, the pair of fourth levers 91, and the pair of third levers 90.

Moreover, in the aforedescribed manner, the third pivot shaft 90*a* is disposed to the opposite side from the first pivot shaft 85*a* with respect to the driven roller 70. In so doing, as compared with a case in which the third pivot shaft 90*a* and the first pivot shaft 85*a* are disposed at a side lying in the same direction with respect to the driven roller 70, the force bearing on drive roller 60 in the paper transport direction (radial direction) can be minimized. Therefore, deviation in the alignment of the drive roller 60 can be minimized.

Moreover, in the aforedescribed manner, the central urging member 84 and the outside urging member 89 are tension springs. In so doing, the pair of central pressing members 83 can readily be urged in uniform fashion by the central urging member 84, and the pair of outside pressing members 88 can readily be urged in uniform fashion by the outside urging member 89.

The embodiment disclosed herein is in all respects exemplary and should not be construed as limiting. The scope of the disclosure is that indicated by the claims, not the preceding description of the embodiments, and shall be considered to further include any modification equivalent in significance to the claims and falling within the scope thereof.

For example, the sheet transport mechanism of the present disclosure is not limited to application in a color printer of inkjet recording type such as that shown in FIG. 1, and application is possible in various other kinds of image forming devices, such as monochrome copiers, digital multifunction printers, fax machines, laser printers, and the like.

In the aforedescribed embodiment, the transport roller pair 13*a* disposed on the first paper transport path 7 was described as an example of the transport roller pair of the sheet transport mechanism of the present disclosure, but there is no limitation thereto. For example, the transport roller pair could be applied in completely analogous fashion to the transport roller pair 13*b* disposed on the second paper transport path 10, the transport roller pair 13*c* disposed on the reverse transport path 12, the resist roller pair 8, the discharge rollers, or the like.

In the aforedescribed embodiment, a case in which the central roller has two roller elements was shown; however, the present disclosure is not limited thereto, and the central roller may have a single roller element instead.

Moreover, in aforedescribed embodiment, an example in which one outside roller was furnished at each axial side of the central roller was shown; however, the present disclosure is not limited thereto, and additional outside rollers may be furnished at each axial side of the outside rollers.

Moreover, in aforedescribed embodiment, an example in which, in order to press the pair of outside roller 72 against the drive roller 60 under uniform pressing force, the outside pressing mechanism 82 is constituted by the pair of outside pressing members 88 for pressing the pair of outside rollers 72 against the drive roller 60, and the outside urging member 89 linked to the pair of outside pressing members 88, for urging the outside pressing members 88 to impart pressing force, but the present disclosure is not limited thereto. For example, a configuration in which the pair of outside pressing members 88 are bridged by an elongated rigid plate, the center of the rigid plate being urged by a compression spring, can also be employed to press the pair of outside roller 72 against the drive roller 60 under uniform pressing force.

What is claimed is:

1. A sheet transport mechanism comprising:

transport roller pairs constituted by drive roller rotated by drive power from a drive source, and driven roller pressed into contact against the drive roller and passively driven thereby; and roller pressing mechanism for pressing the driven roller into contact against the drive roller;

the sheet transport mechanism being adapted to transport a recording medium pinched in a nip section of the transport roller pairs, wherein the driven roller includes a central driven roller disposed to a center side in the axial direction, with a first rotating shaft for supporting the central driven roller, at least one pair of outside driven rollers arranged symmetrically on either side of the central driven roller in an axial direction, and with second rotating shafts for supporting the outside driven rollers;

the roller pressing mechanism includes a central pressing mechanism for pressing the central driven roller into contact against the drive roller, and an outside pressing mechanism for pressing the outside driven rollers into contact against the drive roller;

the central pressing mechanism has a pair of central pressing members for pressing on both ends of the first rotating shaft towards the drive roller side, and a central urging member linked to the pair of central pressing members, and adapted for urging the central pressing members to impart pressing force;

the outside pressing mechanism has a pair of outside pressing members for pressing the pair of second rotating shafts towards the drive roller side, and an outside urging member linked to the pair of outside pressing members, and adapted for urging the outside pressing members to impart pressing force; and the pressing force of the central pressing members exceeds the pressing force of outside pressing members.

2. The sheet transport mechanism according to claim 1, wherein each of the central pressing members disposed at one of both ends of the first rotation shaft, includes a first lever which has a first pivot shaft parallel to the first rotating shaft, and bearing portion for rotatably supporting one end of the first rotating shaft, and which is pivotable about the first pivot shaft; and a second lever which has a second pivot shaft orthogonal to the first pivot shaft, an abutting portion abutting a pivoting end portion of the first lever, and a linking portion disposed to the opposite side from the abutting portion with the second pivot shaft therebetween, and which is pivotable about the second pivot shaft;

the central urging member being linked to the linking portion of the pair of second levers, and adapted to urge the abutting portion of the second levers so as to pivot in a direction of pressing the first levers; and the central driven roller being pressed into contact against the drive roller by the central pressing mechanism.

3. The sheet transport mechanism according to claim 2, wherein the bearing portion of the first lever is disposed between the first pivot shaft and the pivoting end portion of the first lever.

4. The sheet transport mechanism according to claim 1, wherein each of outside pressing members include a third lever which has bearing portion for rotatably supporting one of both ends of rotating shaft of outside driven roller, and which is pivotable about a third pivot shaft extending in a direction parallel to the rotating shaft of the outside driven rollers; and a fourth lever which abut a pivoting end portion of the third lever, and which is pivotable about a fourth pivot shaft orthogonal to the third pivot shaft;

the outside urging member being linked to the pair of fourth levers, and adapted to urge the fourth levers in a direction parallel to the rotating shafts of the outside driven rollers; and the pair of outside driven rollers being pressed into contact against the drive roller, through pivoting of the fourth levers in a direction of pressing the third levers, under the urging force of the outside urging member.

5. The sheet transport mechanism according to claim 4, wherein the bearing portion of the third lever is disposed between the third pivot shaft and the pivoting end portion of the third lever.

6. The sheet transport mechanism according to claim 1, wherein the central pressing member includes a first lever adapted to press against the central driven roller by pivoting about a first pivot shaft extending in a direction parallel to the rotating shaft of the central driven roller;

the outside pressing member includes a third lever adapted to press against the outside driven roller by pivoting about a third pivot shaft extending in a direction parallel to the rotating shaft of the outside driven roller; and the third pivot shaft is disposed to the opposite side from the first pivot shaft, with respect to the driven roller.

7. The sheet transport mechanism according to claim 1, wherein the central urging member and the outside urging member are tension springs.

8. An image forming device comprising the sheet transport mechanism according to claim 1.

* * * * *